US010179687B2

(12) United States Patent
Pini

(10) Patent No.: US 10,179,687 B2
(45) Date of Patent: Jan. 15, 2019

(54) FRESH PRODUCE STORAGE DEVICE

(71) Applicant: SWAY INTERNATIONAL PTY LTD, Greenwich NSW (AU)

(72) Inventor: Peita Pini, Greenwich (AU)

(73) Assignee: Sway International PTY Ltd., Greenwich NSW (AU)

( * ) Notice: Subject to any disclaimer, the term of this patent is extended or adjusted under 35 U.S.C. 154(b) by 0 days.

(21) Appl. No.: 15/118,316

(22) PCT Filed: Feb. 20, 2015

(86) PCT No.: PCT/AU2015/050066
§ 371 (c)(1),
(2) Date: Dec. 23, 2016

(87) PCT Pub. No.: WO2015/123731
PCT Pub. Date: Aug. 27, 2015

(65) Prior Publication Data

US 2017/0129684 A1 May 11, 2017

(30) Foreign Application Priority Data

Feb. 20, 2014 (AU) ..... 2014900539

(51) Int. Cl.
*B65D 81/26* (2006.01)
*B65D 85/50* (2006.01)
(Continued)

(52) U.S. Cl.
CPC ..... *B65D 81/263* (2013.01); *B65B 5/067* (2013.01); *B65B 25/041* (2013.01);
(Continued)

(58) Field of Classification Search
CPC .. B65D 81/263; B65D 63/1018; B65D 81/22; B65D 81/264; B65D 85/34; B65D 85/505; B65B 5/067; B65B 25/041
(Continued)

(56) References Cited

U.S. PATENT DOCUMENTS 4,321,756 A * 3/1982 Mosely ..... A47J 43/24 34/322
5,804,241 A * 9/1998 Isohata ..... B01J 20/28033 426/124
(Continued)

FOREIGN PATENT DOCUMENTS

CN 201001675 Y 1/2008
CN 101204342 A 6/2008
(Continued)

OTHER PUBLICATIONS

Supplementary European Search Report dated Dec. 7, 2016 for corresponding patent application EP15751883.
(Continued)

*Primary Examiner* — Jes F Pascua
(74) *Attorney, Agent, or Firm* — Tutunjian & Bitetto, P.C.

(57) ABSTRACT

A fresh produce storage device has a pocket with an opening for receiving fresh produce. The pocket is formed, at least in part, from a composite sheet of material having at least one inner layer formed from a water permeable material, a central later formed from a water absorbent wadding, and an outer layer formed from a water permeable material.

16 Claims, 4 Drawing Sheets

(51) Int. Cl.

| | |
|---|---|
| ***B65D 81/22*** | (2006.01) |
| ***B65B 5/06*** | (2006.01) |
| ***B65B 25/04*** | (2006.01) |
| ***B65D 63/10*** | (2006.01) |
| ***B65D 85/34*** | (2006.01) |

(52) U.S. Cl.
CPC ..... *B65D 63/1018* (2013.01); *B65D 81/22* (2013.01); *B65D 81/264* (2013.01); *B65D 85/34* (2013.01); *B65D 85/50* (2013.01); *B65D 85/505* (2013.01)

(58) Field of Classification Search
USPC ..... 383/2, 85, 86, 100–103, 117
See application file for complete search history.

(56) References Cited

U.S. PATENT DOCUMENTS

| | | | | |
|---|---|---|---|---|
| 6,015,582 | A * | 1/2000 | Kageyama | B65D 81/264 206/204 |
| 6,375,603 | B1 * | 4/2002 | Yuasa | B26F 1/26 206/204 |
| 7,527,430 | B2 * | 5/2009 | Suskind | B65D 33/06 190/103 |
| 7,841,586 | B1 | 11/2010 | Mongeon et al. | |
| 9,533,810 | B2 * | 1/2017 | Grijalva Varillas | B32B 5/142 |
| 2004/0005422 | A1 * | 1/2004 | Kahler | A47J 36/027 428/36.1 |
| 2006/0172049 | A1 * | 8/2006 | Silver | B65D 29/00 426/419 |
| 2007/0202220 | A1 | 8/2007 | Dicosola | |
| 2008/0190786 | A1 | 8/2008 | Schmidt | |
| 2015/0050414 | A1 * | 2/2015 | Durin-France | B65D 33/01 426/582 |

FOREIGN PATENT DOCUMENTS

| | | | |
|---|---|---|---|
| CN | 201923431 | U | 8/2011 |
| CN | 201942074 | U | 8/2011 |
| EP | 1065155 | A2 | 1/2001 |
| EP | 1418136 | A1 | 5/2004 |
| JP | H03289475 | A | 12/1991 |

OTHER PUBLICATIONS

International Search Report for International Application No. PCT/AU2015/050066 dated Mar. 26, 2015. (5 pages).

Who's Green? "Do You Know How To Store Fresh Produce?" http://whosgreenaz.com/2012/04/06/do-you-know-how-to-store-fresh-produce. Posted Apr. 6, 2012.

Amazon.com "Simple Ecology Organic Cotton Muslin Produce Bag—Set of 6 (2 each of Lg., Med. & Sm.)" https://www.amazon.com/Simple-Ecology-Organic-Cotton-Produce/dp/B004UJ0U0C. Retrieved Nov. 1, 2016.

Chinese Office Action Issued in Chinese Application No. 20158009744.2 dated Feb. 23, 2018, 5 pages.

* cited by examiner

FRESH PRODUCE STORAGE DEVICE

TECHNICAL FIELD

The present invention relates to a storage device for storing fresh produce such as herbs, fruit and vegetables, in a refrigerator.

BACKGROUND OF THE INVENTION

Fresh produce such as herbs, fruit and vegetables are typically stored in a refrigerator to prolong their shelf life and inhibit rotting, infestation and mould growth. The fresh produce is typically stored in a refrigerator in a crisper tray, in plastic bags, in plastic containers or simply on a shelf.

Plastic bags or containers prevent the produce from being adequately ventilated or "breathing". This can lead to an increased rate of loss of nutrients and premature rotting of the produce.

Storing the produce in a crisper tray or on a shelf provides better ventilation and allows the produce to "breathe" but increases the rate of dehydration of the produce due to the flow dry air circulating in the refrigerator and can also lead to an increased rate of loss of nutrients and premature rotting.

Some produce, such as hydroponic lettuce, can be stored with roots intact in a jar of water. This allows the produce to breathe while allowing it to draw water from the jar via its roots, helping prevent dehydration of the produce and maintaining a higher nutrient level for longer. However, produce standing in a jar of water can be difficult to store on a shelf or in a crisper tray of a refrigerator.

OBJECT OF THE INVENTION

It is an object of the present invention to substantially overcome or at least ameliorate one or more of the above disadvantages, or to provide a useful alternative.

SUMMARY OF THE INVENTION

In a first aspect, the present disclosure provides a fresh produce storage device having a pocket with an opening for receiving fresh produce, the pocket being formed, at least in part, from a composite sheet of material comprising:

at least two inner layers formed from a water permeable material;

a central layer formed from a water absorbent wadding; and an outer layer formed from a water permeable material.

In a preferred embodiment, the pocket is formed from a first sheet secured to a second sheet, wherein at least one of the first and second sheets comprises the composite sheet of the first aspect. Preferably, each of the first and second sheets comprise a sheet according to the composite sheet of the first aspect.

Preferably, the first sheet and second sheet are generally rectangular and are secured along three common edges to form a rectangular pocket.

In a preferred embodiment, the storage device further comprises a flap portion formed from a water permeable material, the flap portion extending from an end of the first sheet and adapted to substantially close the opening of the pocket. Preferably, the flap portion is an extension of the first sheet.

Preferably, the storage device is adapted to be rolled into a rolled configuration with the second layer on the inside, the flap portion being adapted to wrap circumferentially around the storage device in the rolled configuration.

Optionally, the storage device further comprises a fastening mechanism adapted to fasten the storage device in the rolled configuration. The fastening mechanism may be one or more straps adapted to wrap around the storage device in the rolled configuration or alternatively, the fastening mechanism may comprise hook and loop fasteners.

In a preferred embodiment, the pocket has an opening extending substantially the width of the pocket.

Preferably, the inner layer or inner layers is/are formed from cheesecloth. Further preferably, the cheesecloth has a thread count of 30 to 90 threads per square inch.

Preferably, the central layer is formed from cotton and/or bamboo wadding.

Preferably, the outer layer is formed from a muslin or calico fabric. Further preferably, the muslin or calico fabric has a thread count of 100 to 200 threads per square inch.

In a second aspect, the present disclosure provides a method of storing fresh produce in a refrigerator, said method comprising:

dousing with water a storage device having a pocket with an opening, for receiving fresh produce, the pocket being formed, at least in part, from a composite sheet of material comprising:

at least two inner layers formed from a water permeable material;

a central layer formed from a water absorbent wadding; and an outer layer formed from a water permeable material;

placing fresh produce in the pocket of the storage device; and placing the storage device in a refrigerator.

In a preferred embodiment, the method further comprises the step of rolling the storage device into a rolled configuration with the second sheet on the inside before the step of placing the storage device in the refrigerator.

In a preferred embodiment, the method further comprises the step of intermittently pouring or sprinkling water on the storage device in the refrigerator to replenish water in the central layer of the storage device.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 1:
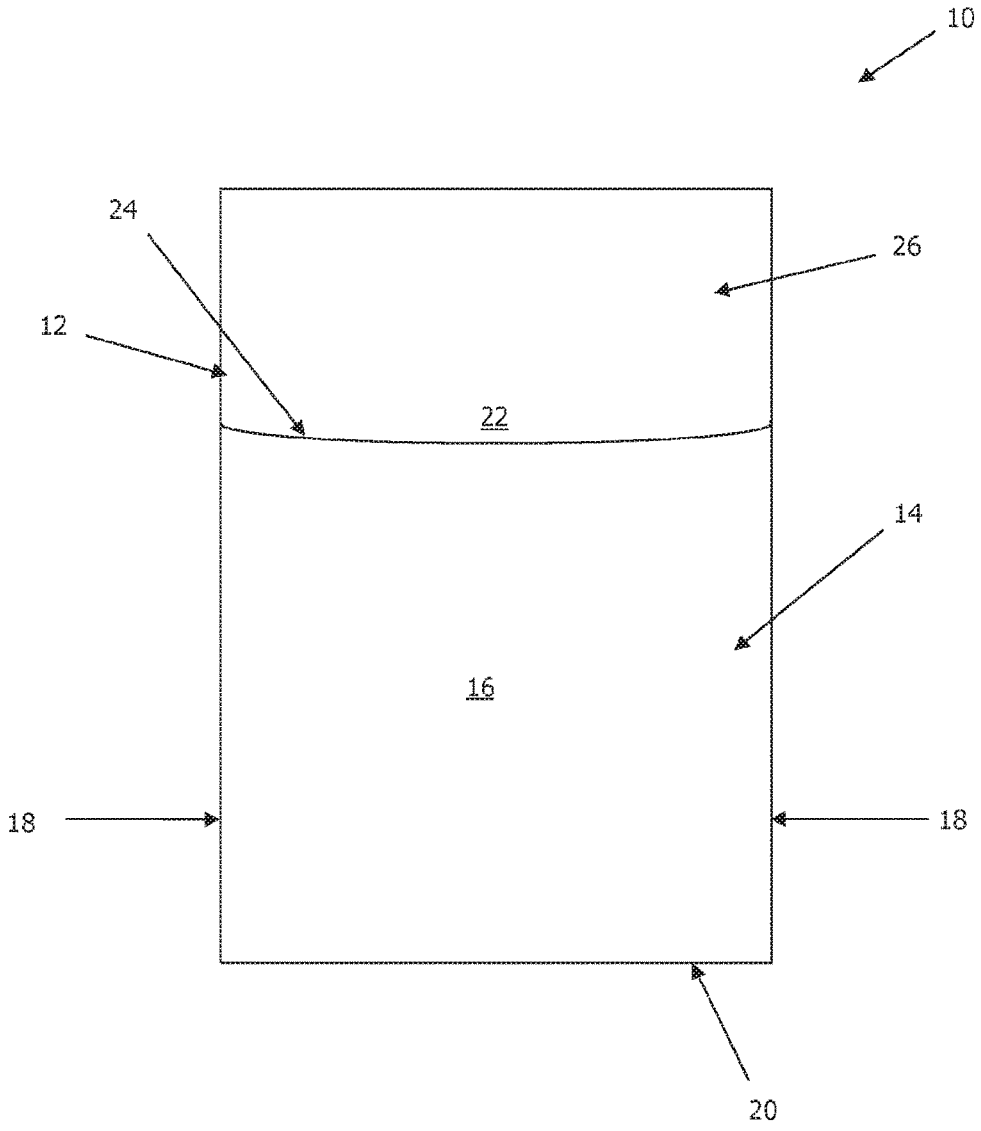
FIG. 1 depicts a fresh produce storage device in an open configuration.

As depicted in FIG. 1, the fresh produce storage device 10 is formed having a generally rectangular first sheet 12 and a generally rectangular second sheet 14.

A pocket 16 is formed between the first sheet 12 and the second sheet 14 with the two sheets 12, 14 being stitched along the side edges 18 and bottom edge 20. The pocket 16 has an opening 22 created by the top edge 24 of the second sheet 14, which is not stitched to the first sheet 12. The opening 22 extends substantially the width of the pocket 16.

In an alternate embodiment, the pocket is formed from a single sheet that is folded back upon itself and stitched along the common side edges.

The first sheet 12 extends beyond the second sheet 14 at the top edge 24 to form a generally rectangular flap portion 26 adapted to fold over and substantially close the opening 22.

Figure 2:
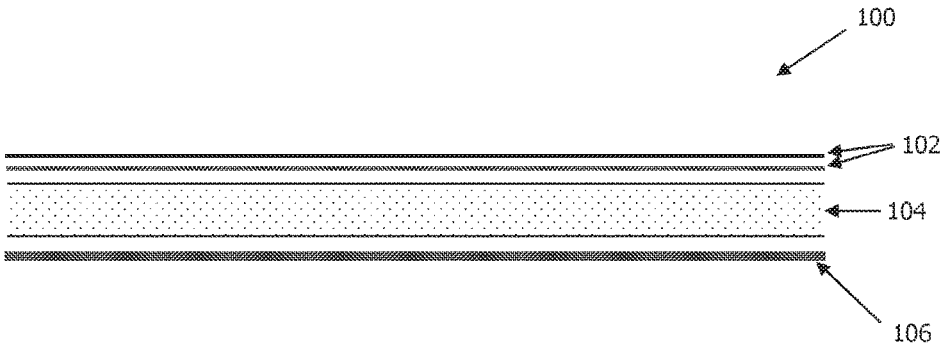
FIG. 2 is a schematic cross-sectional view showing the different fabric layers of the fresh produce storage device of FIG. 1.

As depicted in schematic cross-section in FIG. 2, at least one of the first and second sheets 12, 14 is provided by a composite sheet 100 formed from a plurality of layers of fabric materials 102, 104, 106. The composite sheet 100 has at least one water permeable inner layer 102, a central layer 104 of water absorbent wadding, and a water permeable outer layer 106. The central layer 104 is adapted to absorb water when the storage device becomes wet and to maintain a moist environment for the stored produce, as water evaporates from the central layer 104.

As depicted in the embodiment shown in FIG. 2, the composite sheet 100 has two inner layers 102, which help maintain ventilation between the damp central layer 104 and the stored produce. This helps prevent the produce from becoming too wet, which can also increase the rate of spoiling.

The inner layers 102 are formed from a light, cotton based fabric material, such as cheesecloth, that allows free airflow between the produce and the central layer 104. Cheesecloth suitable for this application typically has a thread count of 30 to 90 threads per square inch.

The central layer 104 is formed from a water absorbent cotton and/or bamboo based wadding material that is able to absorb water and allow it to gradually evaporate over time. In certain embodiments, the central layer 104 may be a cotton blend, a bamboo blend or a cotton and bamboo blend.

The outer layer 106 is formed from a water permeable cotton based material, such as calico or muslin material. One such specific material that is appropriate is a 100% cotton fabric having a thread count of approximately 150 threads per square inch and a surface density of 100 gsm. Muslin or calico fabric suitable for this application typically has a thread count of 100 to 200 threads per square inch.

The fabrics of each layer 102, 104, 106 are preferably formed from 100% natural fibres that are unbleached and organic. This helps maintain a ventilated, moist natural environment, which allows the produce remain fresher for longer, while ensuring that the produce is not contaminated by dyes, chemicals or other hazardous substances.

Figure 3:
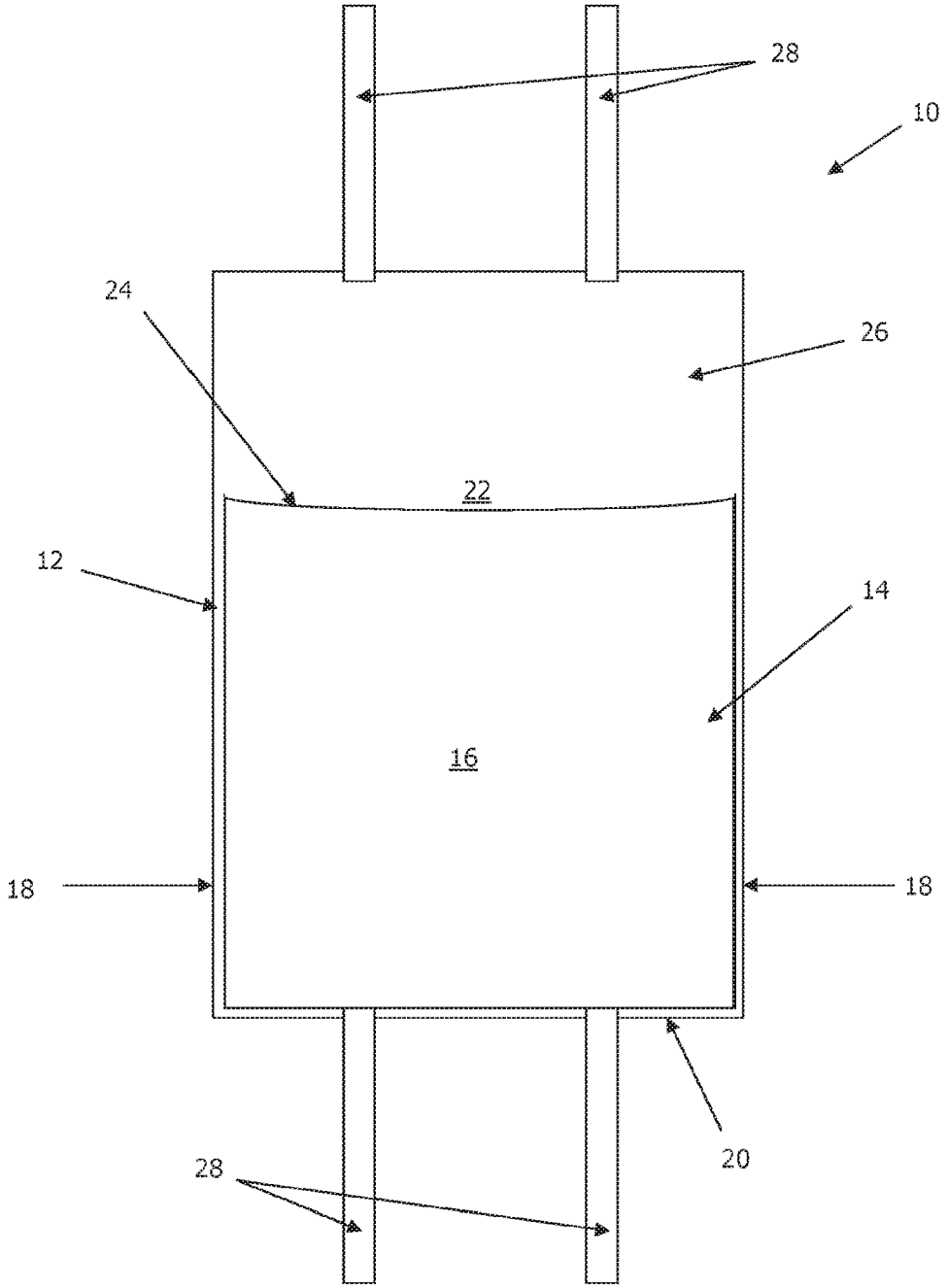
FIG. 3 depicts another fresh produce storage device in an open configuration.

An alternate embodiment is depicted in FIG. 3, which further includes fastening mechanisms, depicted here as tie straps 28, provided on the first sheet 12. Other fastening mechanisms such as hook and loop fasteners or strap and buckle fasteners could equally be used to close the flap 26 over the storage device 10.

Figure 4:
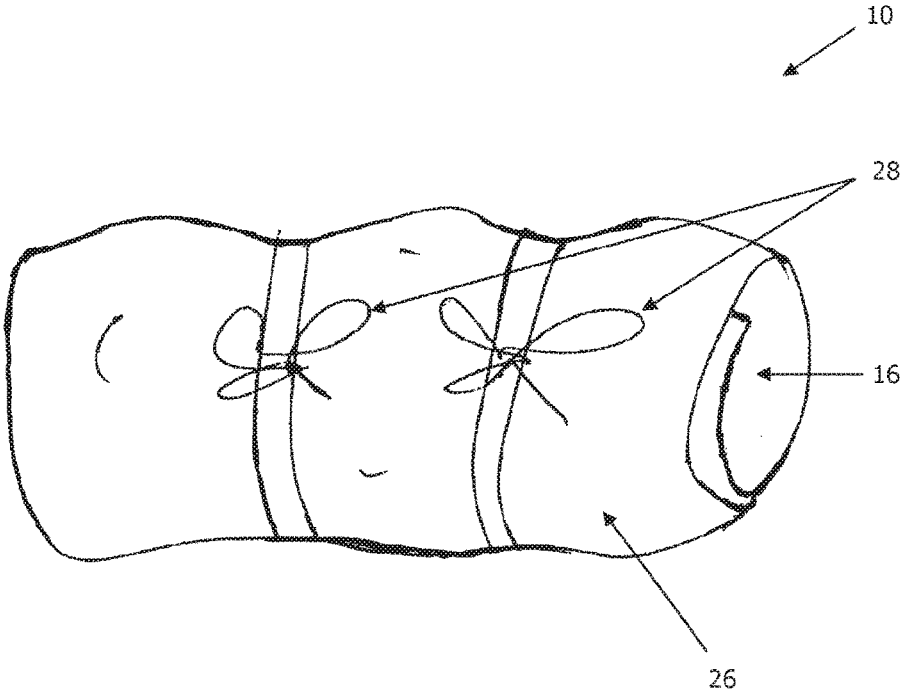
FIG. 4 depicts the storage device of FIG. 3 in a rolled configuration.

In use, the empty storage device 10 is doused with filtered water and wrung lightly to remove excess water. Fresh produce is then placed inside the pocket 16 and the storage device 10 is laid out on a flat surface with the first sheet 12 against the flat surface. The storage device 10 is then rolled with the second sheet 14 on the inside by taking the bottom edge 20 and rolling it up and over and onto the second sheet 14 and continuing to roll upwardly until the flap portion 26 wraps, at least partially, around the rolled pocket 16. As shown in FIG. 4, the tie straps 28 can be tied together to maintain the storage device 10 in the rolled configuration.

The storage device 10 is then placed in a refrigerator for storage. Once a day, or at other regular intervals, the storage device 10 is dampened with water to maintain a sufficient amount of water in the central layer 104. When the storage device 10 is dampened, the outer layer 102 allows most of the water to pass through, while the central layer 104 absorbs the water, drawing it away from the produce, while maintaining a moist environment for the produce to prevent it drying out. As the produce absorbs moisture from the air, water evaporates from the central layer 104 maintaining a moisture content in the air surrounding the produce. This keeps the produce exposed to a constant supply of fresh, moist air, which prolongs the shelf life of the produce and inhibits rotting.

In the rolled configuration, the storage device 10 visually resembles a rolled up swag, which provides an aesthetic appearance. The storage device 10 may be sized for a particular type of fresh produce and may also be coloured and/or printed with images and/or words to indicate a particular fresh produce, so that multiple storage devices can be distinguished, such as one designed for lettuce and another for herbs.

In order to clean the storage device 10, it can simply be hand washed or machine washed.

Although the invention has been described with reference to specific examples, it will be appreciated by those skilled in the art that the invention may be embodied in many other forms.

The invention claimed is:

1. A fresh produce storage device having a pocket with an opening for receiving fresh produce, the pocket being formed, at least in part, from a composite sheet of material comprising:

at least two inner layers formed from a water permeable fabric material;

a central layer formed from a water absorbent wadding; and an outer layer formed from a completely water permeable fabric material;

wherein the central layer is adapted to absorb water applied by the user through said outer layer.

2. The storage device of claim 1, wherein the pocket is formed from a first sheet secured to a second sheet, wherein at least one of the first and second sheets comprise said composite sheet.

3. The storage device of claim 2, wherein both of the first and second sheets comprise said composite sheets.

4. The storage device of claim 2, wherein the first sheet and second sheet are generally rectangular and are secured along three common edges to form a rectangular pocket.

5. The storage device of claim 2, further comprising a flap portion formed from a water permeable material, the flap portion extending from an end of the first sheet and adapted to substantially close the opening of the pocket.

6. The storage device of claim 5, wherein the flap portion is an extension of the first sheet.

7. The storage device of claim 5, wherein the storage device is adapted to be rolled into a rolled configuration with the second sheet on the inside, the flap portion being adapted to wrap circumferentially around the storage device in the rolled configuration.

8. The storage device of claim 7, further comprising a fastening mechanism adapted to fasten the storage device in the roiled configuration.

9. The storage device of claim 8, wherein the fastening mechanism comprises one or more straps adapted to wrap around the storage device in the rolled configuration.

10. The storage device of claim 8, wherein the fastening mechanism comprises hook and loop fasteners.

11. The storage device of claim 1, wherein the opening of the pocket extends substantially the width of the pocket.

12. The storage device of claim 1, wherein the at least two inner layers are formed from cheesecloth.

13. The storage device of claim 12, wherein the cheesecloth has a thread count of 30 to 90 threads per square inch.

14. The storage device of claim 1, wherein the central layer is formed from cotton and/or bamboo wadding.

15. The storage device of claim 1, wherein the outer layer is formed from a muslin or calico fabric.

16. The storage device of claim 15, wherein the muslin or calico fabric has a thread count of 100 to 200 threads per square inch.

* * * * *